United States Patent [19]

Jorgensen

[11] Patent Number: 4,958,108

[45] Date of Patent: Sep. 18, 1990

[54] UNIVERSAL FLUORESCENT LAMP BALLAST

[75] Inventor: Jeffrey A. Jorgensen, Bothell, Wash.

[73] Assignee: Avtech Corporation, Seattle, Wash.

[21] Appl. No.: 310,610

[22] Filed: Feb. 14, 1989

[51] Int. Cl.[5] ..... H05B 41/36

[52] U.S. Cl. ..... 315/307; 315/209 R; 315/308; 315/DIG. 5

[58] Field of Search ..... 315/209 R, 209 T, 219, 315/307, 308, DIG. 5, DIG. 7

[56] References Cited

U.S. PATENT DOCUMENTS 4,870,327 9/1989 Jorgensen ..... 315/307

*Primary Examiner*—David Mis

*Attorney, Agent, or Firm*—Stephen A. Becker; Mikio Ishimaru

[57] ABSTRACT

A ballast having a converter for converting input power into DC at a high frequency and a commutator for converting the DC to AC at a low frequency to cause light emission from a gas discharge lamp. The converter also contains a transformer for converting the input AC to a low voltage AC for heating the filaments in the lamp. Current and Voltage sensors associated with the commutator provide feedback to control circuitry which allows power conversion after the filaments heat and the voltage to the lamp to increase to the voltage required to start the lamp even when different starting voltage requirement lamps are used. After the lamp starts, the lamp is soley current mode controlled. By frequency modulation of the commutator, both power and crest factor can be controlled.

15 Claims, 2 Drawing Sheets

UNIVERSAL FLUORESCENT LAMP BALLAST

FIELD OF THE INVENTION

The present invention relates generally to ballasts for gas discharge lamps, and more particularly to to ballasts for starting and controlling such gas discharge lamps as fluorescent tube lights.

BACKGROUND OF THE INVENTION

In the past, ballasts were developed which converted input alternating current power into direct current power and then into high frequency alternating current power for causing the lamp to emit light. In the aircraft industry, significant weight advantages were realized because high frequency transformers and inductors are lighter than comparable low frequency versions.

However, with these ballasts, the voltage would have to be shaped to a sine wave with an L-C tank circuit and the current would generally have to be limited by an inductive device both of which would result in poor magnetic volt-ampere utilization.

Further, an energy storage, hold-up capacitor was required on the direct current side of the input rectifier to smooth out the rectified sine wave so as to avoid pulsations in the fluorescent light emission. If the capacitor were large, the input conduction angle would be reduced causing a poor power factor, large peak input current, and significant turn-on surge currents. If the capacitor were small, a larger transformer was required to provide greater boost and drop, and the lamp crest factor was undesireably increased because the rectified sine wave would not be smoothed out as much as with a larger capacitor.

To solve some of these problems, the inventor of the present invention developed the High Frequency, Electronic Fluorescent Ballast disclosed in co-pending application Ser. No. 077,760 now U.S. Pat. No. 4,870,327.

Briefly, the input power was converted to direct current in a power converter which provided direct current filament power directly to the lamp and low frequency alternating current to power the lamp via a commutator circuit. A control circuit controlled open circuit voltage and peak current to precise level by pulse width modulation of the power converter.

While the prior invention significantly advanced the state of the art, it did not address a major problem which was how to use the same ballast for different fluorescent lamps of varying lengths and wattages.

To provide a "universal" ballast, ay power converter must be capable of producing a wide range of output voltages at full output current. Preferably, the dynamic characteristics of the power converter should not change appreciably with changes of the output voltage over its entire range. In particular, there should be no shifts from discontinuous to continuous conduction in the power converter as the output voltage requirement drops with shorter lamps.

Further, it is desireable that there be some type of sequencing be provided to assure that full filament power is applied for a controlled period to heat the filaments before the high starting voltage is applied to start the lamp. This is required to prevent premature burn out of the filaments due to cold starts.

A universal ballast needs to have a provision for providing whatever minimum voltage is required to start any lamp regardless of length. Since gas discharge lamps have reverse resistance characteristics, over voltage conditions could lead to catastrophic failure of the lamps if the starting voltage continues to increase after the lamp starts. No such ballasts have heretofore been developed.

To assure maximum lamp life regardless of lamp length, the crest factor of lamp current (the ratio of peak current to RMS current) should be low, and preferably below 1.6.

In addition to a low crest factor, the power factor should be high, preferably above 0.85. However, even when the internal filter energy storage is kept as low as possible consistant with minimizing EMI, previous ballasts have either had low crest factor and low power factor or high crest factor and high power factor.

Still further, a universal ballast should have the peak current and average current track so that each provides the same percentage of their respective full output simultaneously, regardless of output voltage. This is to assure good power factor (good tracking of current and voltage) and crest factor simultaneously rather than the tradeoff which always occurred with the prior art as described above.

Finally, there should be a mechanism for reducing output power when different conditions require. This would include the installation of lamps which are outside the original design specifications of the ballast, ambient temperatures which exceed the proper operating conditions, or even automatic dimming when exterior light conditions indicate that full lighting is no longer required.

SUMMARY OF THE INVENTION

The present invention provides a "universal" ballast for powering gas discharge lamps of varying lengths and wattages.

The present invention further provides a ballast having a lamp starting sequence for applying filament power before lamp power to gas discharge lamps of varying lengths and wattages.

The present invention still further provides a ballast wherein the crest factor may be controlled and optimized.

The present invention additionally provides a ballast wherein the crest factor and the power factor can be controlled and optimized.

The present invention additionally provides a ballast wherein the output power can be automatically controlled based on different ambient conditions.

The above and even more additional advantages of the present invention will become apparent to those skilled in the art from a reading of the following detailed description when taken in conjunction with the accompanying drawings.

DESCRIPTION OF THE PREFERRED EMBODIMENT

Figure 1:
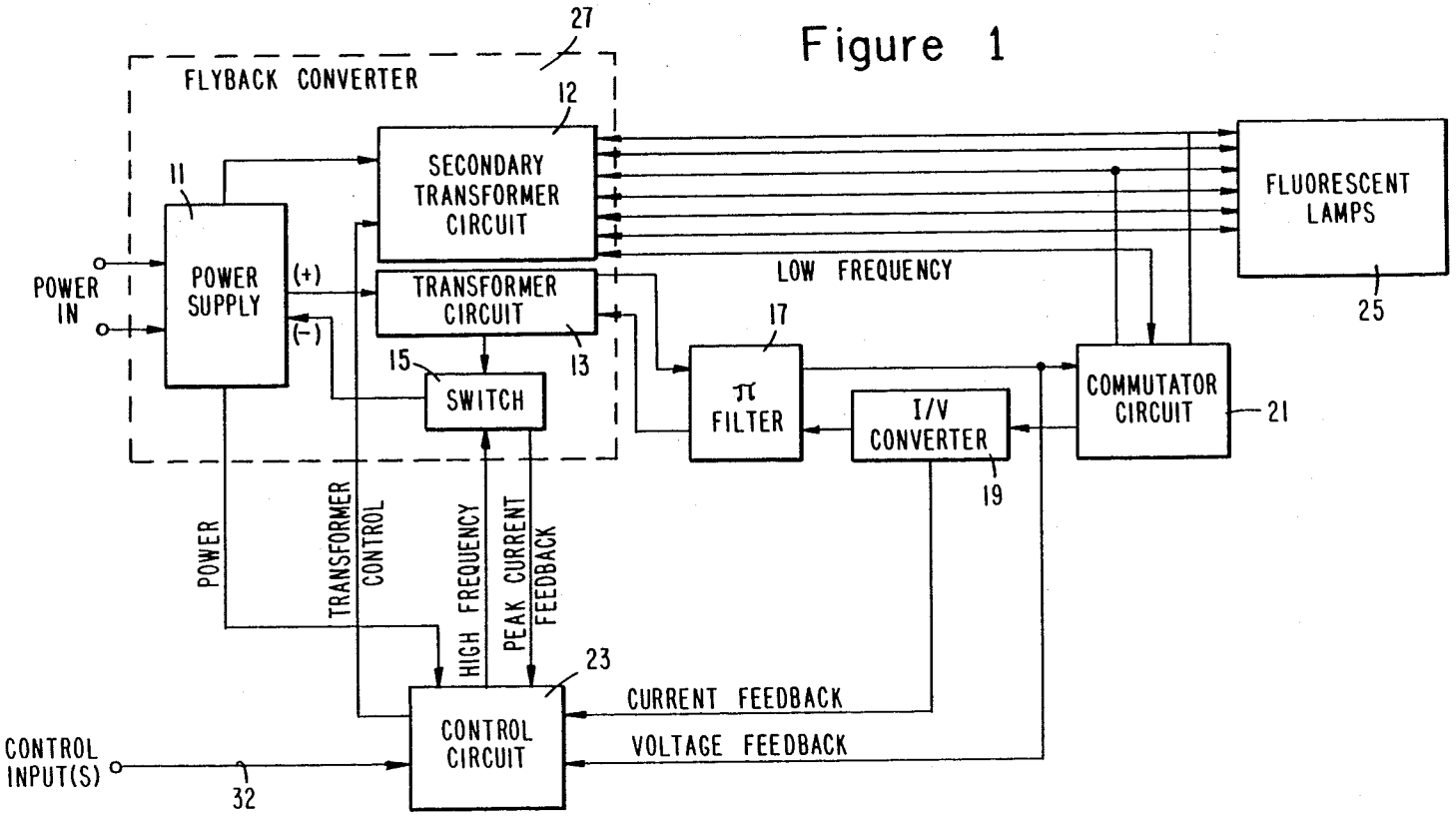
FIG. 1 is a functional block diagram of the universal ballast of the present invention.

Referring now to FIG. 1, therein is shown the universal ballast of the present invention in functional block diagram form. This block diagram is similar to the block form of the high frequency, electronic fluorescent lamp ballast described above. The input power from an exterior source of power is connectible to a power supply 11 which is connected to a secondary transformer circuit 12 which may be turned on and off by a control signal to be hereinafter described.

The power supply 11 is further connected to a transformer circuit 13 which makes conversions of power from the power supply at high frequency into direct current power and which is turned on and off by a switch 15. The switch 15 contains a peak current sensor (not shown) which may be of any of the conventional types which are well known in the art to produce an output signal representative of the peak current through the switch 15. The direct current power output of the transformer circuit 13 is connected to a pi filter 17.

The pi filter 17 is connected to a commutator circuit 21. The return of direct current power from the commutator circuit 21 is connected to a current to voltage (I/V) converter 19 which is a sensor for providing a voltage representative of the current passing through the commutator. The I/V converter 19 is then connected through the pi filter 17 back to the transformer 13.

The commutator circuit 21 is also directly connected to the secondary transformer circuit 12 to receive low frequency signals therefrom to cause conversion of direct current power from the pi filter 17 into low frequency alternating current power through the use of a transistor bridge circuit (not shown) in a manner which is well known in the art. Essentially, the commutator circuit 21 responds to alternating current signals from the secondary transformer 12 to convert direct current power from the transformer circuit 13 in the transistor bridge circuit into alternating current power.

The power supply 11, the secondary transformer circuit 12, the switch 15, the I/V converter 19, and the connection between the pi filter 17 and the commutator circuit 21 are all connected to a control circuit 23.

Also shown in FIG. 1. are fluorescent lamps 25 (either two as indicated by the leads or one which would require only half the leads) which are conventional gas discharge tubes having electrode filaments at each end (not shown). The fluorescent lamps 25 are connectible to the secondary transformer circuit 12 to receive power therefrom for filament heating and to the commutator circuit 21 to receive low frequency alternating current lamp power therefrom which causes the lamp to emit light.

With the exception of the control circuit 23, elements making up the other blocks of FIG. 1 would be apparent to those skilled in the art without undue experimentation.

It should be specifically noted that the universal ballast of the present invention is the only ballast which can be used to drive either single or double tube fluorescent lamps without the need for any type of configuration change in the ballast circuitry itself.

Figure 2:
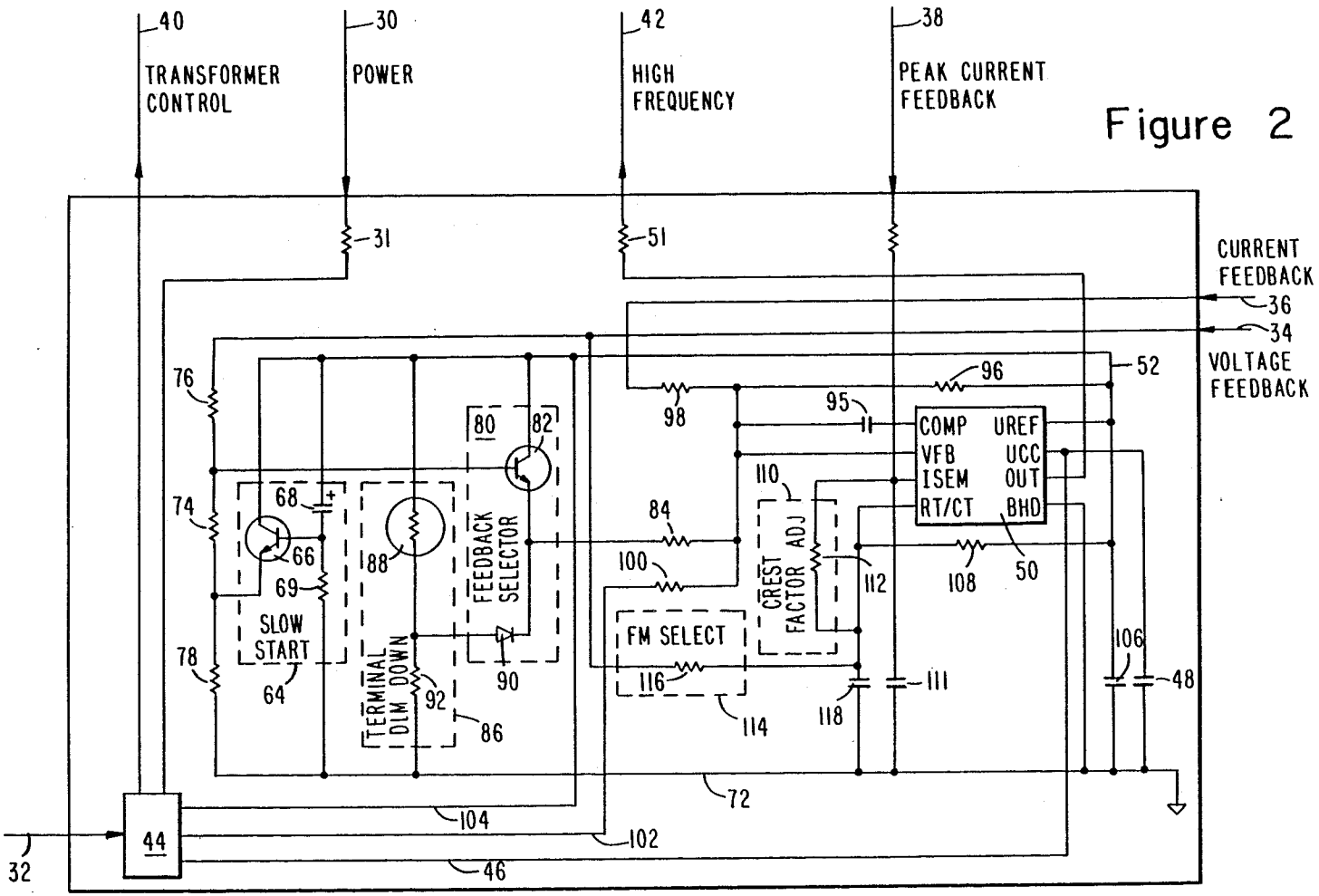
FIG. 2 is a circuit schematic of a portion of the block diagram of the present invention.

Referring now to FIG. 2, therein is shown a circuit schematic of the control circuit 23. A power lead 30 from the power supply 11 (FIG. 1) provides power to the control circuit 23. An operator can control turn the fluorescent lamps 25 off, dim, and bright by providing control input(s) at a control input 32.

The control circuit 23 has further inputs on a voltage feedback lead 34 which comes from the connection between the pi filter 17 and the commutator 21, a current feedback lead 36 from the I/V converter 19, and a peak current feedback lead 38 from the switch 15.

In the preferred embodment, all the control signals from the control circuit 23 go out on a filament transformer lead 40 to the secondary transformer circuit 12 and on a high frequency switching lead 42 to the switch 15. It should be noted that continuous control of fluorescent lamp brightness could also be achieved by controlling current through the I/V converter 19.

Examining the conrol circuit 23 more closely, it will be found that the power lead 30 through a resistor 31, the control input 32, and the secondary transformer lead 40 are all connected to switch circuitry 44.

The switch circuitry 44 is made up of conventional elements arranged in a manner which is generally widely known in the field to which the invention pertains. One of the elements in the "on" condition provides power over a lead 46, which is connected to ground by a capacitor 48, to a conventional regulating pulse width modulator integrated circuit 50. In the preferred embodiment, the integrated circuit 50 is a UC 1843 linear integrated circuit from Unitrode Corporation of Lexington, Mass. 02173.

By way of reference, the UC 1843 has the following terminals: "COMP" is the output of an internal error amplifier which routes internally to the comparator which control pulse width of the signal out of the terminal "OUT" through the resistor 51 to the high frequency switching lead 42 and the switch 15; "VFB" is the voltage feedback to the inverting input of an internal error amplifier whose noninverting input is at a reference voltage which in the preferred embodiment is 2.5 volts; "ISEN" is the input terminal for the peak current feed back which is internally connected to provide the current ramp waveform for the current mode control of the OUT terminal; "RT/CT" is the oscillator control for changing the frequency of the square wave pulses out of the "OUT" terminal; "GND" is ground; "VCC" is the terminal to which the lead 46 is connected to supply power for the integrated circuit 50; and "VREF" is a low temperature coefficient precision reference which in the preferred embodiment is 5.0 volts.

The VREF is connected to a reference lead 52 which in turn is connected to slow start circuitry 60, and more particularly to the collector of an NPN transistor, which is designated as slow start transistor 66. The base of the transistor 66 is connected by a capacitor 68 to the reference lead 52 and by a resistor 70 to ground lead 72. The emitter of the transistor 66 is connected by resistors 74 and 76 to the voltage feedback lead 34 and by a resistor 78 to the ground lead 72.

The reference lead 52 is further connected to feedback selector circuitry 80, and more particularly to the collector of an NPN transistor, which is designated as feedback selector transistor 82. The base of the transistor 82 is connected to the voltage feedback lead 34 by the resistor 76. The emitter of transistor 82 is connected by a resistor 84 to VFB of the integrated circuit 50.

The reference lead 52 is also connected to thermal dim down circuitry 86, and more specifically to a themister 88 which is connected by a diode to the emitter of transistor 82 of the feedback selector circuitry 80 and by a resistor 92 to the ground lead 72.

The reference lead 52 is still further connected to VFB by a resistor 94 and to COMP by a capacitor 95. The current feedback lead 36 is also connected by a resistor 98 to VFB, by the capacitor 96 to COMP. by the resistor 84 to the feedback selector circuit 80, and by a resistor 100 and "dim" lead 102 to the switch circuitry 44 and thence by a "bright" lead 104 to the reference lead 52.

Before the reference lead 52 is connected to ground by a capacitor 106, it is connected by a resistor 108 to RT/CT. Similarly, the peak current feedback lead 38 is connected by a resistor 109 to ISEN before it is connected to ground by a capacitor 111. Also connected to RT/CT is the peak current feedback lead 38 by a crest factor adjustment 110 which consists of a resistor 112. The resistor 112 carries signals both from the peak current feedback lead 38 as well as the current ramp out of ISEN. The voltage feedback lead 34 is also connected to RT/CT by a frequecy modulation (FM) select 114 which consists of a resistor 116. The RT/CT input terminal is further connected by a capacitor 118 to the ground lead 78.

In operation, a control input 32 to the control circuit 23 causes the incoming power on power lead 30 to be switched to provide a signal out on the transformer control lead 40 to turn on the secondary transformer circuit 12. The secondary transformer circuit 12 then takes power from the power supply 11 and transforms it into a relatively low voltage, low frequency alternating current to heat the filaments of the fluorescent lamps 25.

Simultaneously with the turning on of the secondary transfomer circuit 12, power is supplied along the lead 46 to the VOC terminal of the integrated circuit 50.

With the integrated circuit 50 powered up, the terminal VREF places the reference voltage on the reference lead 52. This reference voltage starts to charge the capacitor 68 in the slow start circuitry 64 towards the reference voltage. The capacitor 68 has a relatively slow exponential charge rate. The reference voltage causes the transistor 66 to turn on which produces a square step voltage on its emitter and imposes a voltage across the resistor 74 to cause the transistor 82 in the feedback selector circuitry 80 to turn on.

When the transistor 82 turns on, the reference voltage is applied across the resistor 84 to the VFB terminal of the integrated circuit 50. This voltage inhibits the signal out of the OUT terminal which means that the switch 15 is switched off which means that the transformer circuit 13 is off also. Essentially, the slow start circuitry 60 programs a certain feedback voltage below which the transformer 13 is off. The certain voltage is at zero initially and the capacitor 68 causes it to ramp up exponentially towards a predetermined maximum voltage.

The exponential charging of the capacitor 68 is sufficiently slow that the filaments have between one to three seconds to heat and are well heated before the certain voltage can reach the starting voltage of the lowest voltage lamp. Generally, the lowest voltage fluorescent lamp 25 would be the shortest lamps for which the ballast is designed.

The slow start transistor 66 will turn off when the emitter reaches the value set by the resistors 74, 76, and 78 and this in turn causes the feedback selector transistor 82 to be turned off. This brings the voltage at VFB down to its reference value which allows the high frequency low impedance output signal out of OUT. The signal OUT into the high frequency lead 42 will turn on the switch 15 to cause the transformer circuit 13 to operate. The output of the transformer circuit 13 will be filtered by the pi circuit 17 and will be provided therefrom directly to the commutator circuit 21.

As well known in the art, the commutator circuit 21 will then apply the low frequency alternating current to the already heated filaments of the fluorescent lamps 25. The voltage of the low frequency alternating current will continue to increase until the fluorescent lamps 25 start and light emissions begins. The combination of the hot filaments and the slow rise time afford each particular length lamp the opportunity to start at the lowest possible voltage.

Once the fluorescent lamps 25 start and begin to emit light, the voltage drops since the arcing of the lamp causes the gas to become conductive. With the drop in voltage as sensed over the voltage feedback lead 34, the feedback selector transistor 82 will effectively be out of the circuit. In effect, the required starting voltage of any gas discharge lamps used with the present invention dictate the voltage at which the ballast will start the lamps.

If the fluorescent lamps 25 do not start due to external faults or because no lamps are inserted, then the starting voltage will limit at the predetermined maximum voltage, set primarily by the resistor 76, at which the feedback selector transistor 82 will be turned on. This maximum would be just above the starting voltage of the longest or highest voltage lamp for which the ballast is designed. In the preferred embodiment, this predetermined maximum open circuit voltage is 600 volts.

Once the fluorescent lamps 25 start, the slow start transistor 66 will be off and the feedback selector transistor 82 will be off so VFB will be at its designated reference voltage. Thus, the voltage feedback lead 34 will no longer affect the integrated circuit 50 which will be operating under current mode control responsive only to peak current feedback and current feedback.

Referring now to the thermal dim down circuitry 86, one other feature of the feedback selector circuitry 80 is that the ballast of the present invention can be made to be condition sensitive. For example an unlimited number of linear feedback paths can be added to the emitter connection of the feedback selector transistor 82 to allow feedback from such things as ambient temperature, exterior light conditions, etc. The only requirement for each path is that it have its own diode and that it is of low impedance relative to the current feedback path. The threshold of each path is the bias voltage of VFB plus the associated diode drop. If the path is not of sufficiently low impedance, the feedback impedance can be reduced by using the base-emitter junction of a bipolar transistor as the diode with the collector connected to VREF.

In the preferred embodiment, the thermistor 88 in the thermal dim down circuitry 86 senses the temperature at the ballast and turns OUT off if the temperature reaches th point where there might be excessive energy waste or the circuit might be damaged. This might occur if a lamp which exceeds the design specifications is inserted accidentally.

Further, it has been found desireable to provide a continuous reduction in output current as high temperatures are encountered because much of the internal dissipation of the ballast are directly dependent upon the magnitude of the output. With the termistor 88, the ballast will stabalize at the maximum output power consistent with internal temperature.

Referring now to the crest factor adjustment 110, therein is shown a designed in adjustment. Since the input voltage to the transformer circuit 13 is a rectified sine wave half cycle, it is undesireable to maintain the duty cycle of the OUT pulses to the switch 15 constant because the current out of the power supply 11 will be a rectified sine wave. This will make the current and voltage into the lamp 25 be sine functions which makes the power a sine function having an excellent power factor in the order of one but a high and undesireable crest factor in the order of two.

To control both the power factor and the crest factor, the crest factor adjustment 110 mixes in a signal from the RT/CT terminal and the peak current feedback signal on peak current feedback lead 38 to provide a modified peak current feedback signal into the ISEN terminal which changes the duty cycle or pulse width of the pulses out of the OUT terminal. By selection of the resistor 112, it is possible to obtain a power factor of greater than 0.85 and a desireable crest factor of 1.6 in the preferred embodiment.

By way of reference, it should be noted that while peak current in previous systems could only be set for one given load, the present invention provides a certain adjustable peak current control system which can accommodate varying lamps with the same ballast.

An additional advantage of the present system is that input filter damping can be provided with the control loop. While not shown in the figure, those skilled in the art would realize that input filtering is required in actual systems and that the input filter can ring excessively when driving a negative impedance load such as provided by a current mode controlled converter. The mixed waveform produces a superposition of load characteristics such that the positive resistive characteristic of the voltage mode control dampens input filter ringing due to line commutation. This input filter ringing persists essentially unchecked when pur current mode control is used.

Referring now to the FM select 114, therein is shown another designed in adjustment. The converter 13, which is commonly used in the art, operates in both continuous and discontinuous modes. This means that in the discontinuous mode, on current discharge, the current goes to zero. In continuous mode, the current does not go to zero and the converter 13 is unstable when being controlled by any type of feedback loop. When there are a very wide range of load currents and voltages, and feedback loops are being used for control, it is desireable that the converter 13 always be operated in the discontinuous mode.

To remain in discontinuous mode with the converter 13, it is necessary to reduce the frequency of the on-off operation of the switch 15 so as to give the internal inductor in the converter 13 more time to discharge so the current can go to zero. Thus the FM select 114 makes the frequency of the oscillator of the integrated circuit 50 vary depending upon the voltage feedback on voltage feedback level 34. When the feedback voltage is low, this means that there will be less voltage for the inductor of the transformer in the converter 13 to discharge into so it will require more time so the FM select 114 feeding back into the RT/CT terminal will reduce the frequency of the pulses out of the OUT terminal. This means that the open loop voltage feedback control approaches infinity as the power decreases toward zero. Therefore, the FM select 114 advantageously extends the range of discontinuous operation for the converter 13.

Another advantage of frequency modulation by the FM select 114 is that it continuously shifts spectral components of the EMI due to switching so that improved narrow band performance is achieved.

As many possible embodiments may be made of the invention without departing from the scope thereof, it is to be understood that all matter set forth herein or shown in the accompanying drawings are to be interpreted in an illustrative and not a limiting sense.

I claim:

1. A ballast for controlling the operation of a gas discharge lamp comprising:

converter means connectible to a source of power for selectively converting at a first frequency said source power into direct current power;

commutator means operatively connected to said converter means for converting at a second frequency said direct current power therefrom to alternating current power, said commutator means connectible to said gas discharge lamp to provide said alternating current power at said second frequency thereto to cause said gas discharge lamp to emit light;

sensing means connected proximate to said commutator means for sensing power to said gas discharge lamp through said commutator means, and providing lamp power feedback representative thereof; and control means connected to said converter means, said commutator means, and said sensing means, said control means including input means connected to said converter means for causing said converter means to commence conversion of said source power into direct current power, and said control means including lamp power feedback responsive means responsive to said lamp power feedback to start said gas discharge lamp in accordance with the starting power requirements thereof and operate said gas discharge lamp in accordance with the operating power requirements thereof.

2. The ballast as claimed in claim 1 wherein said converter means includes transformer means for transforming said source power into heating power for said gas discharge lamp; and said control means includes starting means responsive to said lamp power feedback to commence said converter means selectively converting said source power into direct current power after said gas discharge lamp begins heating.

3. The ballast as claimed in claim 1 wherein said converter means includes peak current sensing means for sensing the peak current of said direct current power through said converter means and providing peak current feedback representative thereof; said control means incudes peak current feedback responsive means for causing said converter means to terminate conversion of said source power into direct current power when said peak current feedback exceeds a certain magnitude; said control means includes adjustment means connected to said peak current sensing means and said lamp power feedback means for changing said certain magnitude of said peak current with changes in said lamp power; and said control means includes means for changing the duration of said conversions of said source power into said direct current power for said commutator when said certain magnitude of said peak current is exceeded.

4. The ballast as claimed in claim 1 wherein said control means includes modulation means connected to said lamp power feedback responsive means for modulating the frequency of each of said converter means selective conversions of said source power into direct current power.

5. The ballast as claimed in claim 1 wherein said converter means includes condition responsive means connected to said lamp power feedback responsive means for causing said converter means to terminate conversion of said source power into direct current power when a predetermined condition occurs.

6. A ballast for controlling the operation and the light emitted by a gas discharge lamp having any starting voltage requirement, comprising:

converter means connectible to a source of power for selective convertion at a high frequency said source power into direct current at a high voltage;

commutator means connected to said converter means for converting at a low frequency lower than said high frequency said direct current at said high voltage into alternating current at a low frequency and a variable voltage, said commutator means connectible to said gas discharge lamp to provide said alternating current at said low frequency thereto to cause said gas discharge lamp to emit light;

current sensing means connected proximate to said commutator means for sensing current to said gas discharge lamp through said commutator means, and providing a current feedback signal proportional thereto;

voltage sensing means connected proximate to said commutator means for sensing voltage to said gas discharge lamp through said commutator means, and providing a voltage feedback signal proportional thereto; and control means connected to said converter means, said commutator means, and said current sensing means, said voltage sensing means, said control means including input circuitry for providing a turn on signal, said control means including control circuitry responsive to said turn on signal to cause said converter means conversion of said source power into direct current and to said voltage feedback signal and said current feedback signal above a predetermined magnitude to terminate conversion of said source power into said direct current whereby said starting voltage requirement of said gas discharge lamp determines the starting voltage thereof and said current determines the operation and control thereof.

7. The ballast as claimed in claim 6 wherein said gas discharge lamp includes a pair of filaments; said converter means includes transformer means connectible to said gas discharge lamp for selectively transforming said source power into heating power for heating said pair of filaments; and said control means includes starting means for causing said converter means to cause said converter means conversion of said source power into direct current after said pair of filaments have been heated.

8. The ballast as claimed in claim 6 wherein said converter means includes high frequency switching means for selectively allowing the passage of current through said converter means, said high frequency switching means including peak current sensing means for providing a feedback proportional to peak of said current; and said control means includes peak current feedback responsive means responsive to said current feedback and said peak current feedback to cause said high frequency switching means to terminate switching when said peak current feedback signal exceeds a certain magnitude.

9. The ballast as claimed in claim 6 wherein said control means includes frequency modulation means connected to said control circuitry for modulating the frequency of said converter means selective conversions of said source power into direct current power.

10. The ballast as claimed in claim 6 wherein said control means includes a condition responsive sensor responsive to the occurrence of a predetermined condition to provide a signal indicative thereof; and said control circuitry includes means for causing said converter means to terminate conversion of said source power into direct current when said condition responsive sensor provides said signal.

11. A ballast for operating and controlling light emitted by a gas discharge tube having any starting voltage requirement, comprising:

converter circuitry connectible to a source of power for selectively converting at a high frequency said source power into direct current at a high voltage, said converter means including switching means for causing and terminating said selective converting;

commutator circuitry connected to said converter circuitry for converting at a low frequency lower than said high frequency said direct current at said high voltage into alternating current at a low frequency and a variable voltage, said commutator circuitry connectible to said gas discharge tube to provide said alternating current at said low frequency thereto to cause said gas discharge tube to emit light;

a current to voltage converter connected to said commutator circuitry for sensing current applied to and through said gas discharge tube through said commutator circuitry, and providing current feedback signals as a voltage proportional thereto;

a voltage sensing connection to said commutator circuitry for sensing voltage applied to said gas discharge tube through said commutator circuitry for providing voltage feedback signals as a voltage proportional thereto; and control means connected to said converter circuitry, said commutator circuitry, and said current to voltage sensor, said voltage sensing connection, said control means including a feedback selector connected to said current to voltage converter and said voltage sensing connection responsive to a current or voltage feedback signal exceeding a predetermined voltage to provide a feedback signal, said control means including control input switch circuitry for providing an input signal, said control means including a modulator circuit connected to said feedback selector and said control input switching circuitry and said converter circuitry switching means responsive to said input signal for causing said converter circuitry to convert said source power into said direct current at said high voltage and responsive to said feedback signal to terminate conversion oof said source power into said direct current at said high voltage whereby said required starting voltage of said gas discharge tube determines the starting voltage thereof and said current determines the control and operation thereof.

12. The ballast as claimed in claim 11 wherein said gas discharge tube has filaments disposed at each end; said converter circuitry includes a transformer connectible to said gas discharge tube for selectively transforming said source power into cirect current at a lower voltage than said high voltage to heat said filaments; and said control means includes slow start circuitry responsive to said input signal to provide said feedback signal for a predetermined period of time whereby said filaments are heated before voltage for starting said gas discharge tube is applied thereto.

13. The ballast as claimed in claim 11 wherein said converter circuitry includes a peak current sensor for sensing the peak current of said direct current power through said converter circuitry and providing a peak current feedback signal representative thereof; said control means includes peak current feedback signal responsive means for causing said converter circuitry to terminate conversion of said source power into direct current power when said peak current feedback signal exceeds a certain magnitude; and said control means includes a crest factor adjustment connected to said peak current sensor and said modulator circuit for changing said certain magnitude of said peak current feedback signal whereby the duration of said conversions of said source power into said direct current power for said commutator circuitry are changed.

14. The ballast as claimed in claim 11 wherein said control means includes a frequency modulation select connected to said modulation circuit for frequency modulating the frequency of each of said converter circuitry selective conversions of said source power into direct current power.

15. The ballast as claimed in claim 11 wherein said converter circuitry includes thermal dim down circuitry connected to said modulation circuit for causing said converter circuitry to terminate conversion of said source power into direct current power when the temperature proximate said control means exceeds a predetermined temperature.

* * * * *